US006973278B2

(12) United States Patent
Miller et al.

(10) Patent No.: US 6,973,278 B2
(45) Date of Patent: Dec. 6, 2005

(54) PHOTORECEPTOR MODULE WITH MULTI-FUNCTIONAL HANDLE

(75) Inventors: Gregory P. Miller, Rochester, NY (US); Erwin Ruiz, Rochester, NY (US); Steven J. Fiore, Hilton, NY (US)

(73) Assignee: Xerox Corporation, Stamford, CT (US)

( * ) Notice: Subject to any disclaimer, the term of this patent is extended or adjusted under 35 U.S.C. 154(b) by 116 days.

(21) Appl. No.: 10/721,487

(22) Filed: Nov. 25, 2003

(65) Prior Publication Data

US 2005/0111879 A1 May 26, 2005

(51) Int. Cl.[7] ..... G03G 15/02

(52) U.S. Cl. ..... 399/116; 399/159; 399/162

(58) Field of Search ..... 399/107, 110, 111, 399/116, 117, 159, 162

(56) References Cited

U.S. PATENT DOCUMENTS 5,708,924 A * 1/1998 Shogren et al. ..... 399/116
5,787,322 A * 7/1998 Sass et al. ..... 399/110
6,236,823 B1 * 5/2001 Lee ..... 399/116

OTHER PUBLICATIONS

Fiore, et al—Photoreceptor Module with Retracting Backer Bars, filed Sep. 4, 2003, U.S. Appl. No. 10/654,783.

* cited by examiner

*Primary Examiner*—Hoan Tran
(74) *Attorney, Agent, or Firm*—Joseph M. Young

(57) ABSTRACT

A photoreceptor module for an electrophotographic device that includes a tension roller, a photoreceptor belt, which wraps around a plurality of backing members and the tension roller, and a rotatable handle. When the handle is in a first position it engages at least one other module within the device to maintain proper spacing between the at least one other module and the photoreceptor module. When the handle is in a second position, the tension roller is retracted so that the belt may be removed more easily.

20 Claims, 9 Drawing Sheets

PHOTORECEPTOR MODULE WITH MULTI-FUNCTIONAL HANDLE

The present invention relates to printing devices and more precisely to a handle that can be used to remove modules therefrom as well as assist in replacing a photoreceptor belt.

The internal components of modern printing devices are generally grouped into various modules. For example, in many devices the photoreceptor, the members that support the belt, and the drivers that keep the belt in motion are part of one module called the photoreceptor module. In addition to the photoreceptor module, the device will typically include other modules such as, for example, a developer module and a fusing module.

Like many technologies, there is always a desire for printing devices that operate faster, have more features, and occupy less space. In machines that are more intricate the tolerances for spacing between different modules, such as, for example, the photoreceptor module and the developer module, are very tight. It is important that the relative positions of the modules remain constant. This can be true even when the machine is not in use. For example, if the photoreceptor belt on the photoreceptor module contacts the developer module or the transfer module while the module is inserted into or extracted from a printing device, the belt could become damaged. Therefore it is important that the spacing between modules stay as constant as possible while modules are being inserted or removed. The apparatus and method described herein can help assure that the distances between adjacent modules, particularly electrophotographic modules, remains close to tolerances as one is removed from or inserted into a printing device.

Today, it is advantageous if the customer or technician can easily and quickly service the subsystems and components of a machine, but at the same time maintain the delicate spacing between modules.

Embodiments include a photoreceptor module for an electrophotographic device. The photoreceptor module includes a tension roller, a photoreceptor belt, which wraps around a plurality of backing members and the tension roller, and a rotatable handle. When the handle is in a first position it engages at least one other module within the device to maintain proper spacing between the at least one other module and the photoreceptor module. When the handle is in a second position, the tension roller is retracted so that the belt may be removed more easily.

Various exemplary embodiments will be described in detail, with reference to the following figures, wherein.

Figure 9:
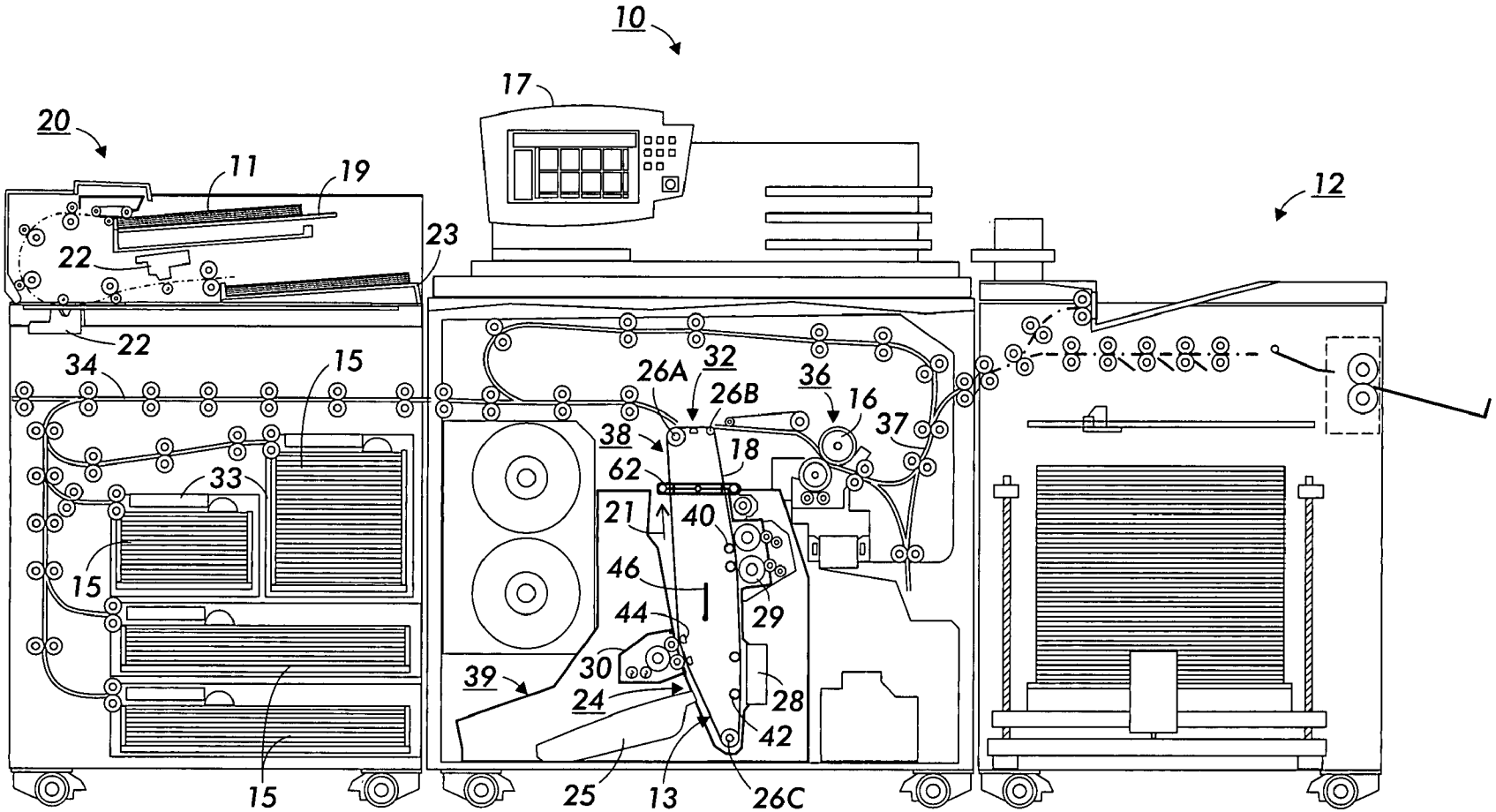
FIG. 9 is a schematic front elevation view of an exemplary embodiment of a printing apparatus including the photoreceptor module.

FIG. 9 shows a schematic front elevation view of an exemplary embodiment of a photoreceptor module 38 in the context of a printing device 10. The printing device 10 could be, for example, a xerographic copier or printer.

In electrophotographic machines, including the exemplary embodiment illustrated in FIG. 9, an image of an original document or set of documents 11 to be reproduced is projected or scanned onto a uniformly charged surface 13 of a photoreceptor 18 to form an electrostatic latent image thereon. Thereafter, the latent image is developed with an oppositely charged developing material called toner (not shown) to form a toner image, corresponding to the latent image on the photoreceptor surface. The toner image is then electrostatically transferred to a final support material or paper sheet 15, to which it may be permanently fixed by a fusing device 16.

In the illustrated device 10 of FIG. 9, a set of original documents 11 to be copied is placed on tray 19 of an automatic document handler 20. The machine operator enters the desired copying instructions, such as, for example, number of copies or sets of copies, through the control panel 17. The automatic document handler transports the documents 11 serially from the tray and past a scanning station 22 which scans each document, thereby producing digital image signals corresponding to the informational areas on the original document. Once scanned, the documents are deposited in an output tray 23. Additionally, information and instructions could come from a data storage medium or, if the device is connected to a network, they could come from a remote location such as a desktop computer.

The image signals are projected upon the uniformly charged surface of the photoreceptor at an imaging station 24 by a raster output system 25 to form a latent electrostatic image of the scanned informational areas of the original document thereon as the photoreceptor is moved passed the imaging station. The photoreceptor 18 is in the form of a flexible, endless belt 18 having a photoconductive outer surface 13 and is mounted on a photoreceptor module 38. A set of rollers 26A, 26B, 26C and a plurality of backing members located opposite various stations support the belt 18. At least one of the rollers 26A is driven to move the photoreceptor belt 18 in the direction indicated by arrow 21 at a constant rate of speed about the rollers and past the various electrophotographic processing stations. Before entering the imaging station 24, a charging station 28 uniformly charges the photoreceptor surface 13. The exposure of the charged surface of the photoreceptor to the digital signals at the imaging station discharges the photoreceptor surface in the areas struck by the digital image signals. Thus, there remains on the photoreceptor surface a latent electrostatic image in image configuration corresponding to the informational areas on the original. As the photoreceptor continues its movement, the latent electrostatic image thereon passes through developing station 30 where oppositely charged toner is deposited on the latent electrostatic image to form a toner image.

The photoreceptor movement continues transporting the toner image from the developer station to a transfer station 32. A paper supply 33 feeds a sheet 15 to a sheet transport 34 for travel to the transfer station. The sheet moves into aligned and registered contact with the toner image at a speed synchronistic with the moving photoreceptor. Transfer of the toner image to the sheet is effected and the sheet with the toner image is stripped from the photoreceptor and conveyed to a fusing station 36 having fuser device 16 where the toner image is fused to permanently fix the toner image to the sheet. After the toner image is fixed to the sheet, the sheet is transported by sheet transporting mechanism 37 to a finishing station 12 where the sheets with the permanent images thereon may be compiled into sets of sheets and finished by being stapled, bound, or the like.

Suitable drive means (not shown) for the document creating apparatus are arranged to drive the photoreceptor in timed relationship to the scanning of the original document and forming the latent electrostatic image on the photoreceptor, to effect development of the latent electrostatic image, to separate and feed sheets of paper, to transport same through the transfer station in time registration with the toner image, and to convey the sheet of paper with the toner image through the fusing station to fix the toner image thereto in a timed sequence to produce copies of the original documents.

The foregoing description is believed to be sufficient for the purposes of showing the general operation of document creating apparatus. FIGS. 1–4 illustrate an exemplary embodiment of the photoreceptor module 38 in greater detail.

To service the components of a printing device, it is sometimes necessary to remove, wholly or partially, portions of the hardware from their position inside the printing device. For example, belt replacement often requires removal of the photoreceptor module from the device to the extent necessary to safely remove the old belt and replace it with a new one.

To ease removal of the photoreceptor module 38 from the device 10, the backing members can be retractable to remove some of the difficulty associated with servicing the photoreceptor module. When backing members are retracted, the spring-loaded tension roller 26C extends further downward and the belt 18 is pulled so that it occupies a narrower space. See FIG. 4. FIG. 3 is the same image as FIG. 2, except the backing members are retracted and the photoreceptor module 38 occupies a narrower footprint.

In embodiments, an actuating mechanism is used to retract the backing members. FIGS. 1–4 show an exemplary lever 46 as the actuating mechanism. The lever 46 connects to some or all of the backing members. In embodiments, actuating the lever 46 allows simultaneous retraction of multiple backing members. When the backing members are retracted the tension roller 26C takes up the slack in the photoreceptor belt 18, this changing the footprint of the photoreceptor module 38. Moving this lever 46 allows the user to adjust the footprint of the photoreceptor module 38. It accomplishes this by retracting at least some of the backing members so that the photoreceptor module 38 changes from its operating mode to its servicing mode. In embodiments, the lever retracts all the backing members simultaneously.

Figure 1:
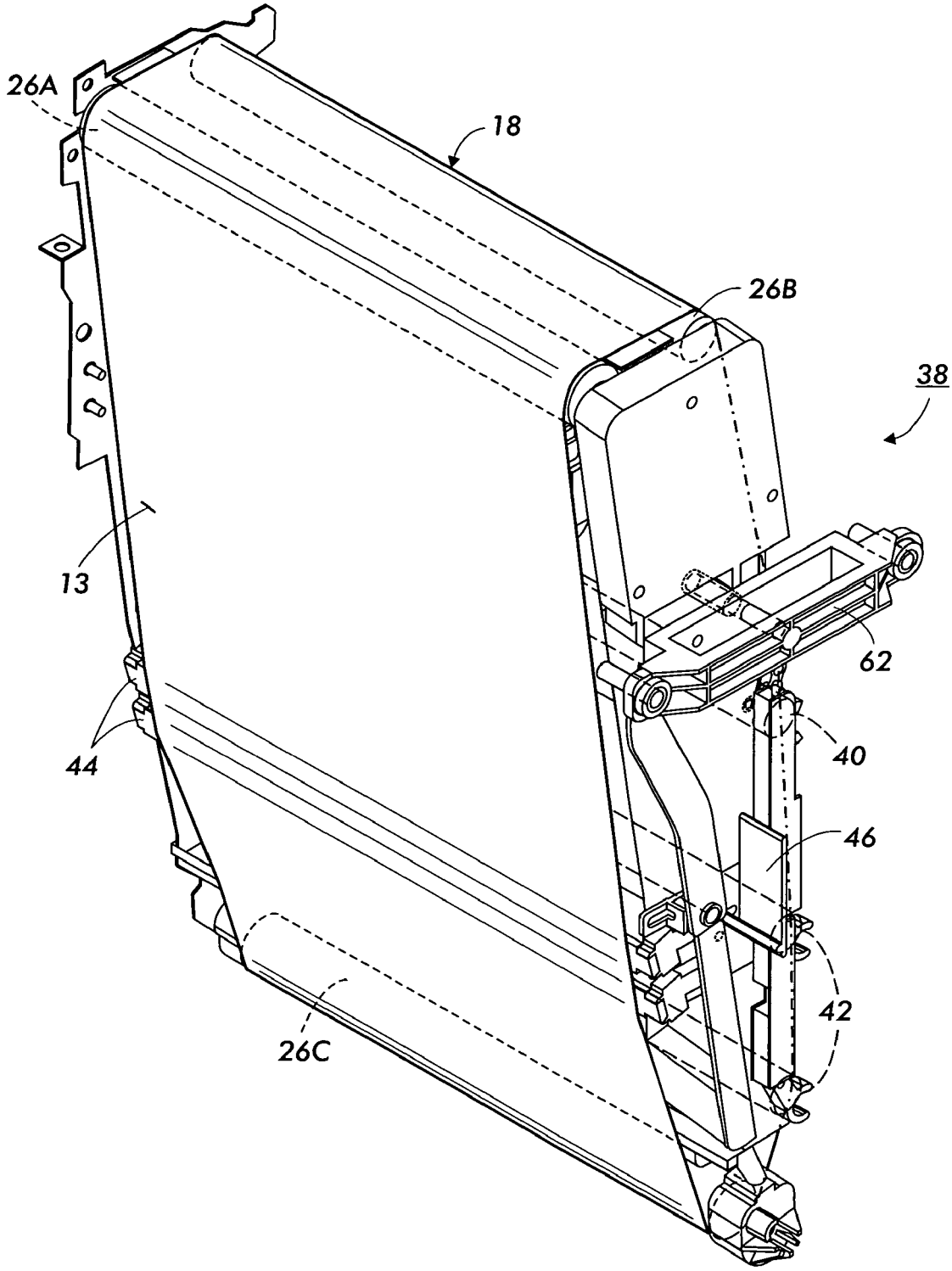
FIG. 1 is a schematic frontal perspective view of an exemplary embodiment of a photoreceptor module in a first position.
Figure 2:
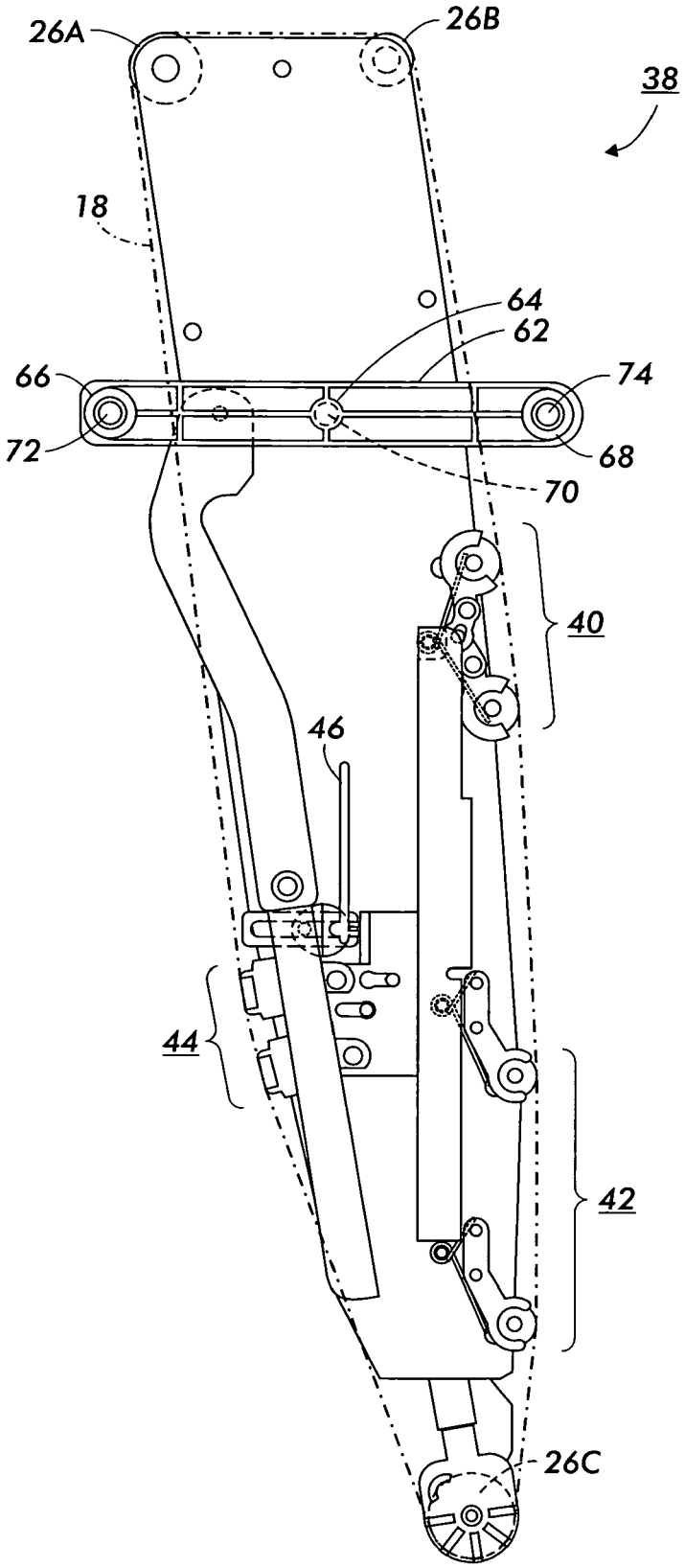
FIG. 2 is a schematic side view of an exemplary embodiment of the photoreceptor module of FIG. 1 in the first position.
Figure 3:
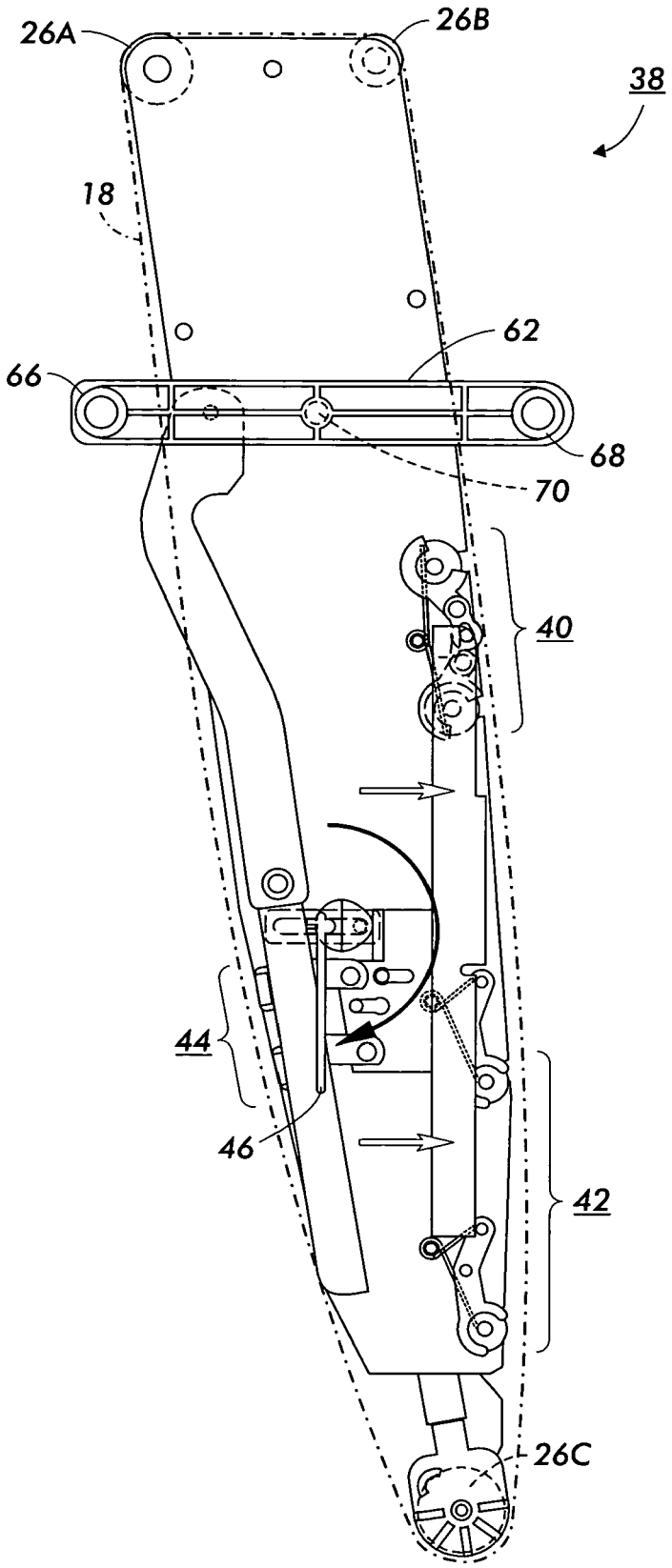
FIG. 3 is a schematic side view of an exemplary embodiment of the photoreceptor module of FIG. 1 in a second position.
Figure 4:
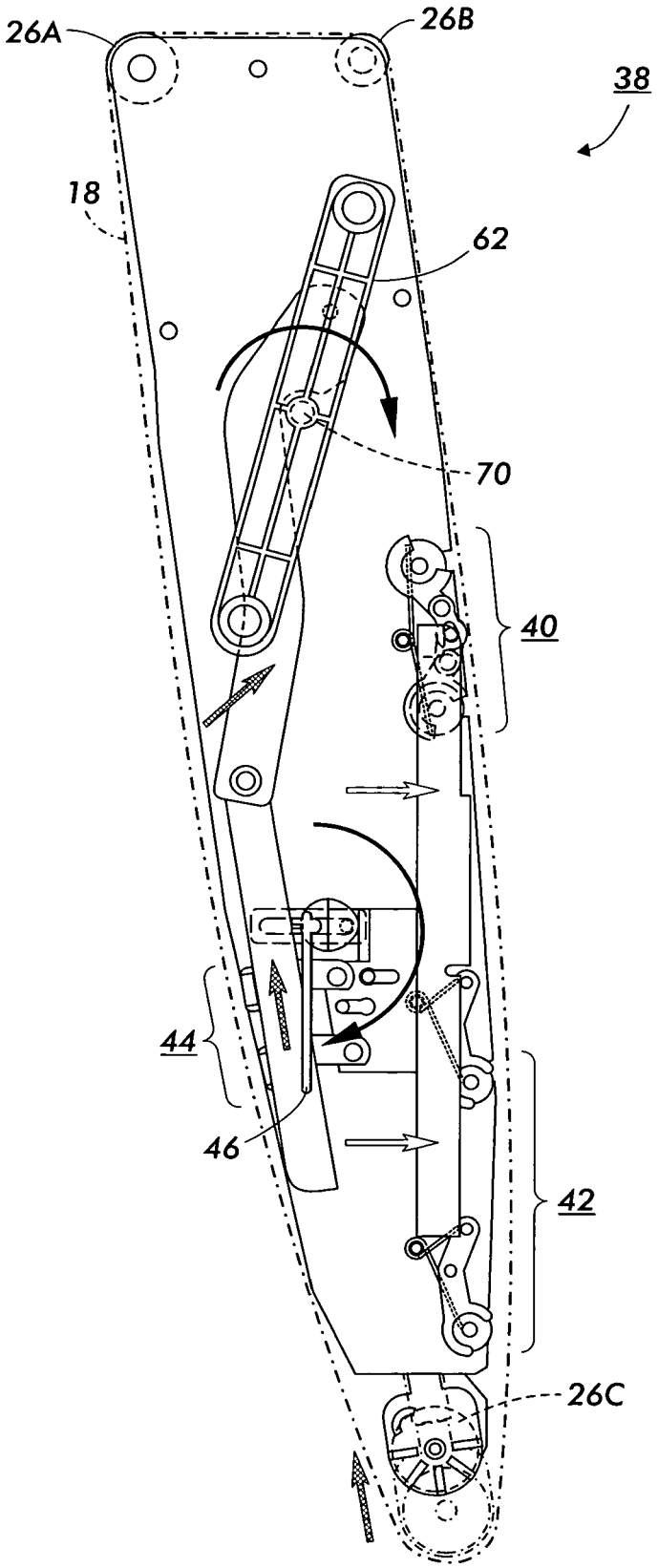
FIG. 4 is a schematic side view of an exemplary embodiment of the photoreceptor module of FIG. 1 in a third position.
Figure 5:
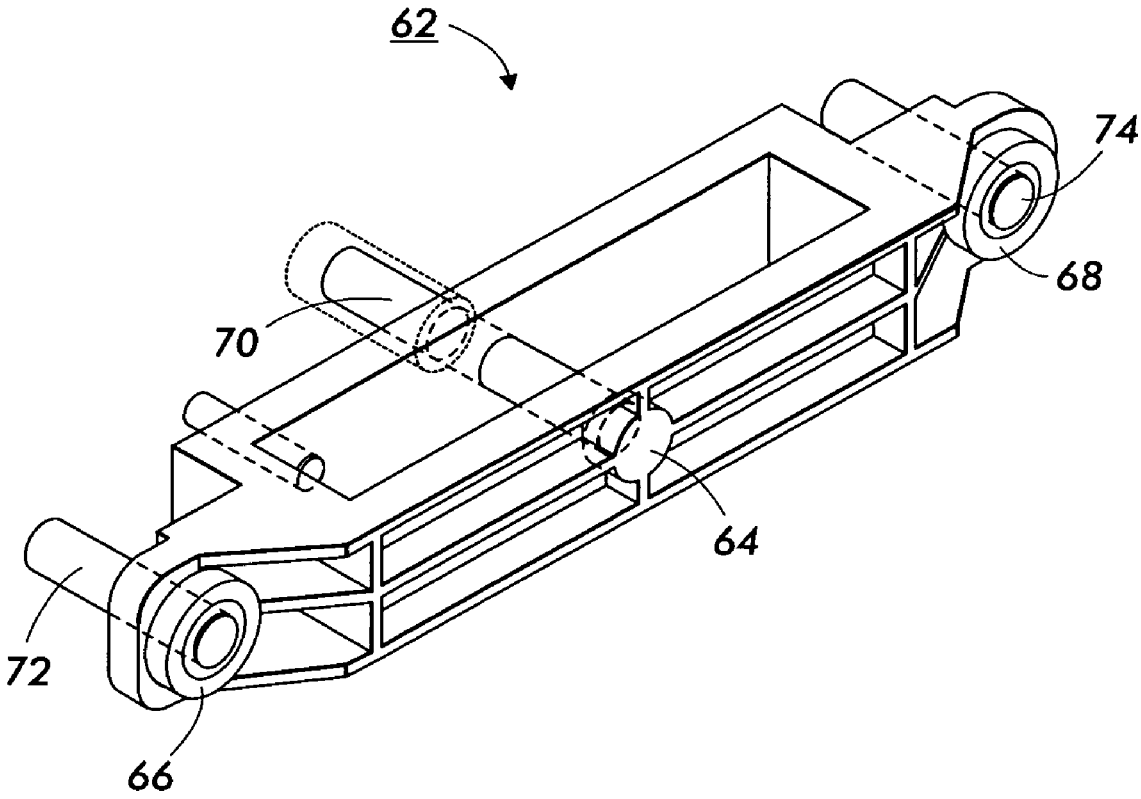
FIG. 5 is a schematic perspective view of an exemplary embodiment of a multi-functional handle.

FIGS. 1 and 2 show the lever 46 in a first position when the photoreceptor module 38 is in its operating position within the device 10. FIG. 3 shows the lever 46 in its actuated position, where the backing members are retracted. In embodiments, the user is blocked from removing the photoreceptor module unless the lever 46 was in its actuated position. This would help prevent accidental damage to the photoreceptor surface.

While the lever 46 has been referred to as having an operating position and an actuated position, it should of course be obvious that the operating position may be referred to as an actuated position and what is termed the actuated position may be referred to as the narrower footprint position of the photoreceptor module. The selection of the operating position as being the starting position was arbitrary. What is important is that the lever 46 can be used to change the footprint of the module between an operating position and a servicing position.

Other types of actuating mechanisms may include an electrical switch, toggle, sliding bar, or push button.

The preceding description of lever 46 and its function was described in U.S. patent application Ser. No. 10/654,783, entitled PHOTORECEPTOR MODULE WITH RETRACTING BACKER BARS, filed Sep. 4, 2003, herein incorporated by reference in its entirety.

A latching mechanism 48 may be used to lock the photoreceptor module to the electrophotographic module 39. A first part of the latching mechanism is located on the electrophotographic module 39 and a second part is located on the photoreceptor module 38. The components of the latching mechanism can be seen in FIGS. 6–8.

Figure 7:
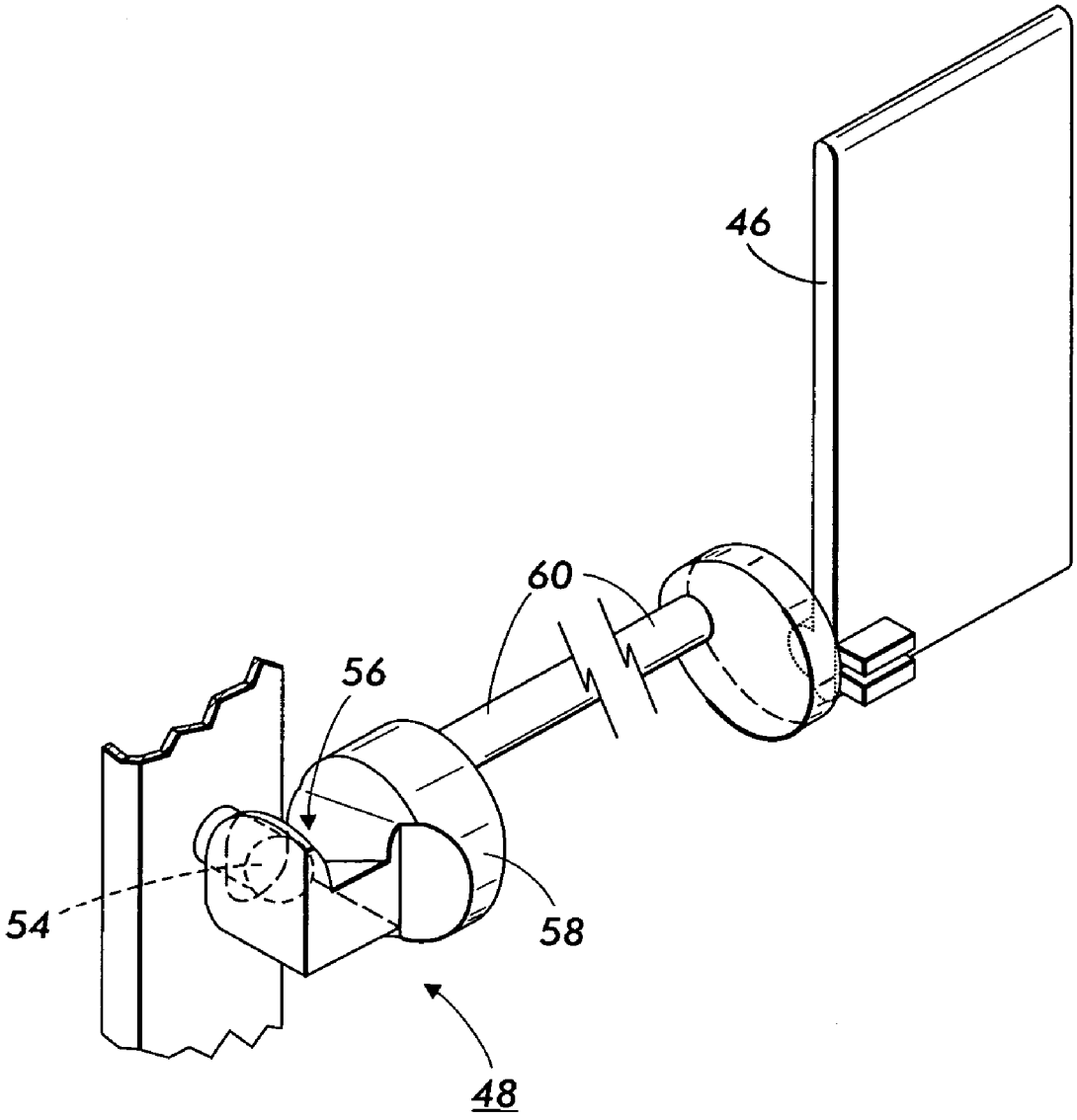
FIG. 7 is a schematic cutaway perspective view of an exemplary embodiment of a latching mechanism in a disengaged position.
Figure 8:
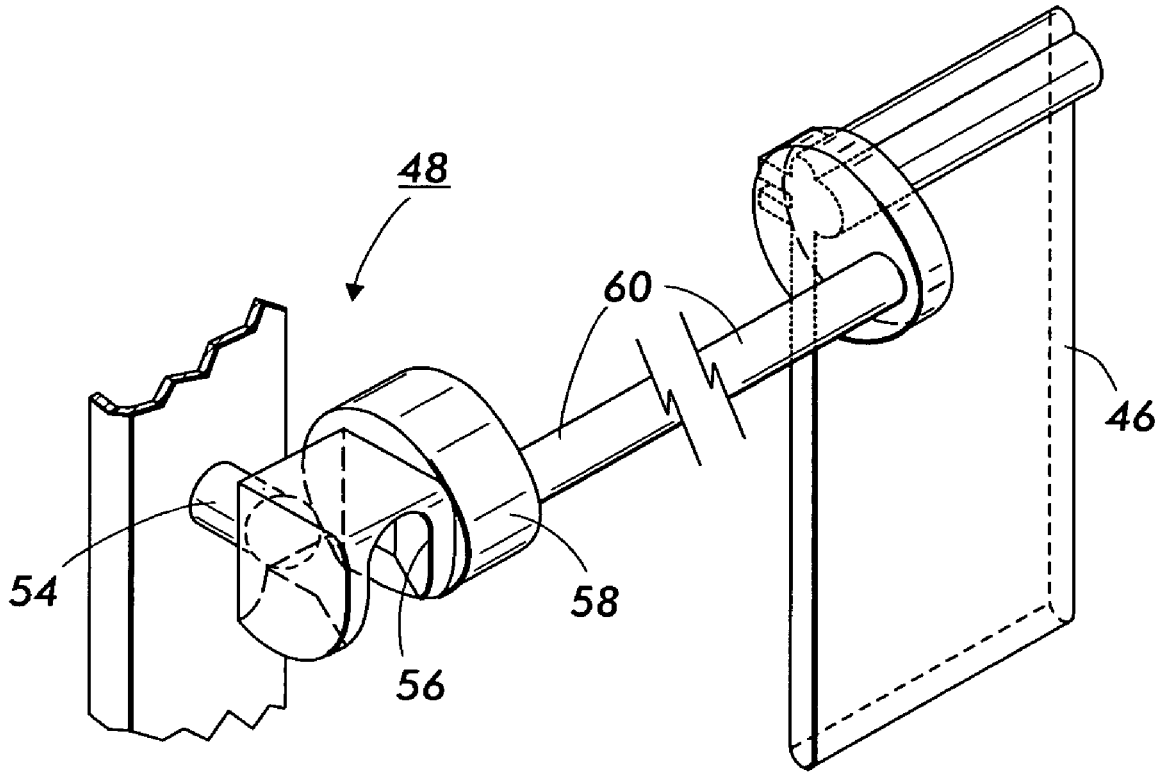
FIG. 8 is a schematic cutaway perspective view of an exemplary embodiment of a latching mechanism in an engaged position.

In embodiments, the first part of the latching mechanism 48 attached to the electrophotographic module 39 includes a spherical pin 54 as can be seen in FIGS. 7 and 8. The second part of the latching mechanism includes a U-shaped throat 56 attached to an inboard cam 58. The cam 58 connects to a shaft 60 that is in turn connected to the lever mechanism 46. When the photoreceptor module 38 is in its operating position within the electrophotographic module 39 the U-shaped throat 56 engages the spherical pin 54. When the lever 46 is rotated approximately 180° to retract the backing members, the U-shaped throat 56 rotates and disengages from the spherical pin 54, thereby allowing the photoreceptor module 38 to be removed from the electrophotographic module 39.

Figure 6:
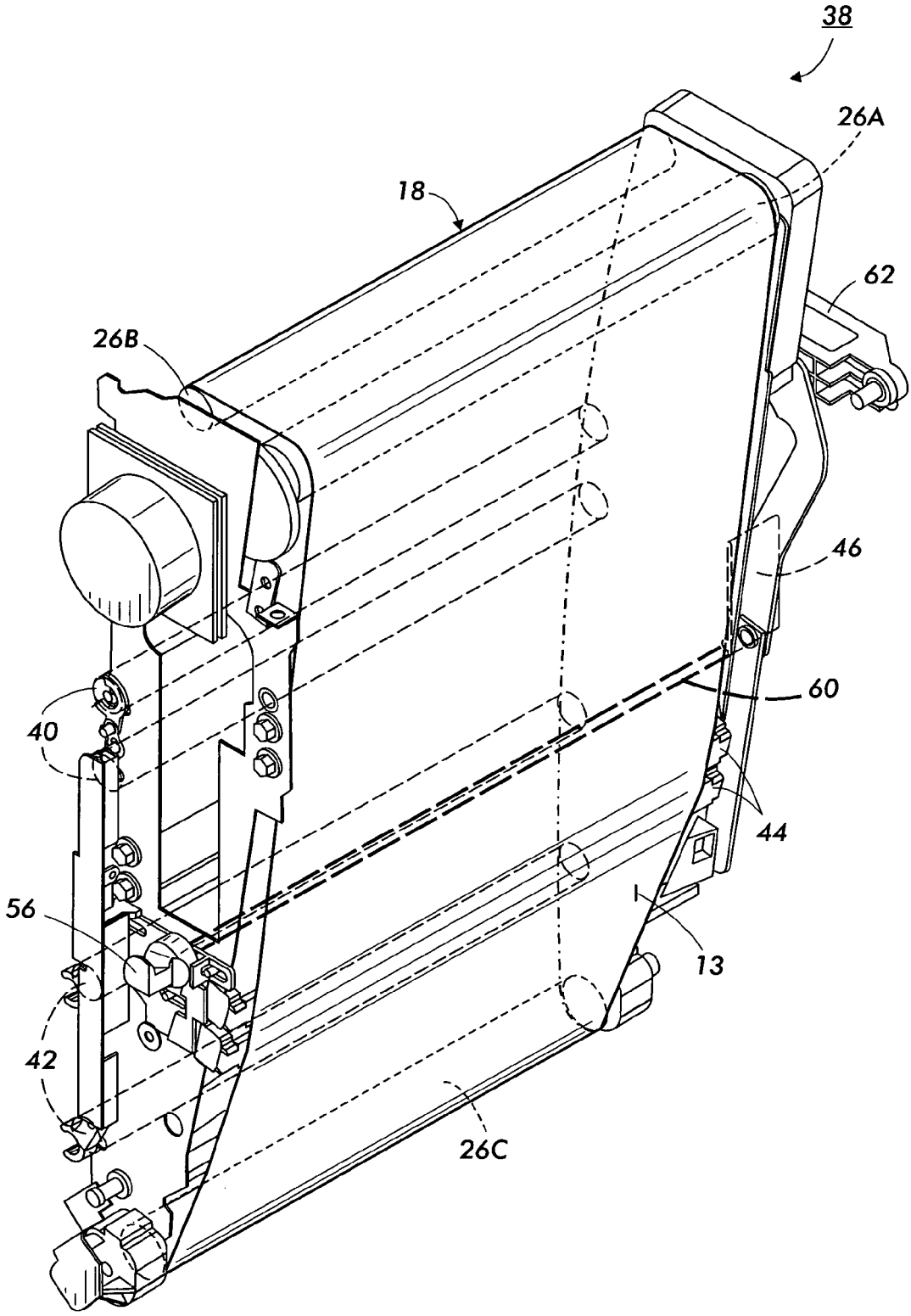
FIG. 6 is a rearward schematic perspective view of an exemplary embodiment of the photoreceptor module of FIG. 1.

The example illustrated in FIGS. 6–8 is exemplary and those skilled in the art could likely substitute other configurations for the latching mechanism.

The latching mechanism 48 serves two primary purposes. First, it assists with keeping the spacing between the belt 18 and the surrounding xerographic components to within tolerances when the modules are in place within the device 10. Second, it allows the user to withdraw either the photoreceptor module 38 or the entire electrophotographic module 39 depending upon the position of the lever 46. In embodiments, the entire electrophotographic apparatus may also be removable from the printing device 10. The photoreceptor module 38 would then be a subunit of the electrophotographic module 39. The latching mechanism 48 gives the user a choice of removing the photoreceptor module 38 or the entire electrophotographic module 39.

In embodiments, the photoreceptor module 38 can be part of a drawer that can be slid in and out of the printing device 10. For example, the photoreceptor module drawer 38 could be mounted to a larger electrophotographic drawer 39 that mounts important electrophotographic systems such as, for example, the developing, charging, transfer, and cleaner stations. In turn, the electrophotographic drawer 39 would be mounted to the remainder of the machine 5 (including, for example, paper feeding and registration, fusing, etc.) It should be noted that the exact location of various features within the printing device 10 might vary from machine to machine. In embodiments, both the photoreceptor module drawer 38 and the electrophotographic module drawer 39 extend from the front of the machine 5.

Because of tight spacing requirements inside printing devices, both the photoreceptor module drawer 38 and the electrophotographic module drawer 39 typically need to be positioned relative to each other to within particular tolerances. For example, in embodiments, these tolerances are +/−0.12 mm. The electrophotographic module 39 also has to be positioned within the printing device 10 to within particular tolerances. The spacing between these modules needs to be maintained when the drawer is being closed (inserted) or opened (removed). This helps prevent damage to the belt. The handle 62 helps maintain the spacing to within tolerances during insertion or removal of the photoreceptor module 38.

The handle 62 for opening and closing the module should be made of sturdy material. For example, the handle may be composed of molded plastic or cast metal designed with ribbing to be very stiff. The handle 62 has a center pivot 64 with two bearings 66, 68 on either side of center pivot 64 accurately located to each other and to the center pivot 64.

The handle 62 mounts and pivots on a center pin 70, which is part of the photoreceptor module 38. The center pin 70 is carefully located with relation to the surrounding components and general structure of the photoreceptor module and the electrophotographic module 39.

To facilitate easy insertion and removal, the bearings 66, 68 can be non-binding and designed to handle a small degree of axial misalignment. In embodiments, the bearings 66, 68 are pressed Spyraflo Bronze bearings, which are non-binding and able to handle a 5-degree axial misalignment.

The bearings fit over projections from the surface of the electrophotographic module 39. In embodiments, the projections take the form of two steel locking pins 72, 74. The location of the locking pins 72, 74 is such that the bearings 66, 68 in the handle 62 fit over them. When the photoreceptor module 38 is inserted within the electrophotographic module 39, the handle 62 slides on to the locking pins 72, 74 on the outboard side of the electrophotographic drawer 39. The locking pins 72, 74 are located so that the spacing between the belt 18 and the various components and structure of the electrophotographic drawer 39 is maintained.

The photoreceptor module drawer 38 locks into position when the handle 62 is positioned on the conical steel pins 72, 74. In embodiments where the photoreceptor module 38 is oriented vertically, the xerographic drawer will often require a larger slot in its front frame for the photoreceptor module drawer 38 to pass through during assembly or service. Due to structural constraints, this can leave one side or the other of the xerographic drawer weak. This will cause a small but potentially significant alignment shift between the left and right sides of the drawer 39. Therefore, one end of the handle 62 is carefully located relative to one of the locking pins 72, 74 and the other end of the handle 62 can guide the weaker side of the electrophotographic drawer 39 (in embodiments, up to 1 mm in a horizontal direction) to within tolerances, thus bringing all the components on the weak side of the electrophotographic drawer 39 into position within predetermined tolerances. In particular embodiments, the left side of the drawer 39 is stronger than the right.

In embodiments, when the photoreceptor module is inserted into position within the electrophotographic module 39 and the handle 62 has been positioned over the locking pins 72, 74, the photoreceptor module 38 may be clamped to the electrophotographic module 39 with the latching mechanism 48. Where a latching mechanism is used, the handle 62 can be used to open either the entire xerographic drawer 39 or the photoreceptor module drawer 38, depending upon how the lever 46 is oriented. If the lever 46 is in a first orientation the latching mechanism between the photoreceptor module and the electrophotographic module 39 is engaged and the entire electrophotographic drawer 39 may be removed from the device 10. Rotating the lever 46 disengages the latching mechanism and retracts the backing members. At which point, a user may remove the photoreceptor module drawer 38 from the device 10 without the remainder of the electrophotographic module.

The handle 62 also serves to provide support the outboard side of the photoreceptor module 38. The weight of the photoreceptor module may cause the outboard end to sag when the photoreceptor module drawer is inserted into and latched to the electrophotographic drawer. The handle 62, when properly situated over the locking pins 72, 74, provides added support to the outboard end of the module 38.

In embodiments, the handle 62 also serves as a lever for retracting the tension roller 26C to a clearance position, thereby easing replacement of the photoreceptor belt 18. As described elsewhere in the application, the belt 18 needs to have sufficient tension to remain flat in, for example, the developing and transfer zones. The tension roller 26C is a spring-loaded roller that keeps the photoreceptor belt 18 taut. In embodiments, the handle 62 is also operably connected to the tension roller 26C. For example, the handle 62 may include a simple mechanical link to the tension roller such that when the handle is rotated the tension roller is retracted/extended. After the photoreceptor module 38 has been removed from the electrophotographic module 39, the handle 62 can be rotated. Rotating the handle 62 retracts the tension roller 26C, thereby facilitating removal/replacement of the photoreceptor belt 18.

In practice, a user of a device incorporating the described photoreceptor module 38 who wanted to service the belt 18 or other part of the module would first power down the device 10. Then the user would actuate the lever 46 on the photoreceptor module 38. Actuating the lever retracts the backing members, which allows the tension roller 26C to descend, thereby narrowing the footprint of the module. A narrower footprint allows the module 38 to be removed from the device 10 more easily. If the photoreceptor module 38 is latched to the electrophotographic module 39, the latching mechanism 48 needs to be disengaged before the photoreceptor module can be removed. In embodiments, the lever 46 could also be used to unlatch the modules from each other. Then the user would remove the photoreceptor module 38. When the module 38 was removed, the belt 18, for example, could be serviced or replaced with a new belt. After the module 38 was serviced, it could be reinserted into the device 10, the lever arm 46 could then be shifted back into its operating position and normal printing could resume.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention.

What is claimed is:

1. An electrophotographic device, which includes a plurality of modules, the electrophotographic device comprising:

a first module;

a handle having first and second ends attached to the first module, the handle having a first bearing located near the first end of the handle and a second bearing located near the second end of the handle;

a first pin, extending from a module other than the first module, a second pin, extending from a module other than the first module, wherein the first and second pins are positioned so that the first pin extends through the first bearing in the handle and the second pin extends through the second bearing in the handle to keep the first module aligned with the at least one other module when the handle is in a first position.

2. The device of claim 1, wherein the first module is a photoreceptor module.

3. The device of claim 2, where the photoreceptor module is part of a drawer.

4. The device of claim 2, wherein the first and second pins extend from different modules.

5. The device of claim 2, wherein both the first and second pins extend from a same second module.

6. The device of claim 5, wherein the same second module is an electrophotographic module including multiple electrophotographic components.

7. The device of claim 6, wherein the photoreceptor module includes a belt, and a tensioning member to tension the belt, wherein the tensioning member retracts when the handle is rotated into a second position.

8. The device of claim 7, further comprising a latching mechanism connecting the photoreceptor module to the electrophotographic module.

9. The device of claim 8, wherein the latching mechanism is a clamp.

10. The device of claim 8, wherein the photoreceptor module includes an actuating mechanism having first and second settings operably connected to the latching mechanism, wherein when the actuating mechanism is set to the first setting the latching mechanism is engaged and when the actuating mechanism is set to the second selling, the latching mechanism is disengaged.

11. The device of claim 10, wherein the actuating mechanism is a lever.

12. The device of claim 7, wherein the first and second pins are each long enough to prevent the handle from being rotated until the first module is moved to a position where the belt can be removed safely.

13. A photoreceptor module, comprising:

a tension roller;

a photoreceptor belt, which wraps around a plurality of backing members and the tension roller, and a rotatable handle, wherein when the handle is in a first position it engages at least one other module to maintain proper spacing between the at least one other module and the photoreceptor module, and wherein when the handle is in a second position, the tension roller is retracted so that the belt may be removed more easily.

14. The photoreceptor module of claim 13, further comprising a lever that can be actuated to retract the backing members so that the photoreceptor module may be more easily moved relative to the at least one other module.

15. The photoreceptor module of claim 14, wherein the handle cannot be moved from the first position to the second position until the lever is actuated.

16. The photoreceptor module of claim 13, wherein the photoreceptor module engages an electrophotographic module including multiple electrophotographic components when the handle is in the first position.

17. The photoreceptor module of claim 16, further comprising a latching mechanism connecting the photoreceptor module to the electrophotographic module.

18. The photoreceptor module of claim 17, wherein the latching mechanism is a clamp.

19. The photoreceptor module of claim 18, wherein the photoreceptor module includes an actuating mechanism having first and second settings operably connected to the latching mechanism, wherein when the actuating mechanism is set to the first setting the latching mechanism is engaged and when the actuating mechanism is set to the second setting, the latching mechanism is disengaged.

20. The photoreceptor module of claim 19, wherein the actuating mechanism is a lever.

* * * * *